US012151865B2

(12) United States Patent
Moreno Brociner et al.

(10) Patent No.: US 12,151,865 B2
(45) Date of Patent: Nov. 26, 2024

(54) MULTI-APERTURE SPILL-RESISTANT SPOUT

(71) Applicant: Winpak Ltd., Winnipeg (CA)

(72) Inventors: Manuel Jose Moreno Brociner, Winnipeg (CA); Mustafa Bilgen, Fayettville, GA (US); Olivier Yves Muggli, Winnipeg (CA); Ashley Robert Andrews, Kleefeld (CA)

(73) Assignee: Winpak Ltd., Winnipeg (CA)

( * ) Notice: Subject to any disclaimer, the term of this patent is extended or adjusted under 35 U.S.C. 154(b) by 0 days.

(21) Appl. No.: 17/811,749

(22) Filed: Jul. 11, 2022

(65) Prior Publication Data

US 2023/0040290 A1 Feb. 9, 2023

Related U.S. Application Data

(60) Provisional application No. 63/260,092, filed on Aug. 9, 2021.

(51) Int. Cl.
*B65D 75/58* (2006.01)
*B65D 47/06* (2006.01)

(52) U.S. Cl.
CPC ..... *B65D 75/5872* (2013.01); *B65D 47/06* (2013.01)

(58) Field of Classification Search
CPC ..... B65D 75/5872; B65D 75/5877; B65D 75/5883; B65D 75/5866; B65D 75/5861;
(Continued)

(56) References Cited

U.S. PATENT DOCUMENTS 2,951,619 A 9/1960 Strumor
4,896,796 A * 1/1990 Harris ..... B65D 81/32 222/129

(Continued)

FOREIGN PATENT DOCUMENTS

CA 2190060 A1 * 11/1996

OTHER PUBLICATIONS

International Search Report and the Written Opinion of the International Searching Authority, International Patent Application No. PCT/IB2022/056400, dated Oct. 17, 2022, pp. 1-12.

(Continued)

*Primary Examiner* — Javier A Pagan
(74) *Attorney, Agent, or Firm* — Bond, Schoeneck & King, PLLC

(57) ABSTRACT

A spill-resistant spout and method of injection molding a spill-resistant spout. The spill-resistant spout includes a conduit portion having an exit aperture in fluid communication with a central channel; and a seal portion having a bottom surface, the seal portion secured to the conduit portion and in fluid communication with the central channel, the bottom surface comprising at least two intake apertures configured to receive foodstuffs from a container. The use of multiple intake apertures increases the surface tension on the foodstuffs attempting to pass through the intake apertures while maintaining or increasing the total flow volume of foodstuffs through the spill-resistant spout. Additionally, the barrier qualities of the spill-resistant spout can be enhanced by providing one or more discrete layers of thermoplastic material and one or more layers of barrier material within at least one portion of the spill-resistant spout.

11 Claims, 10 Drawing Sheets

(58) Field of Classification Search
CPC .... B65D 47/06; B65D 47/061; B65D 47/063; B65D 47/068; B65D 47/04
See application file for complete search history.

(56) References Cited

U.S. PATENT DOCUMENTS

| | | | | |
|---|---|---|---|---|
| 8,083,109 | B2 * | 12/2011 | Smith | B65D 75/5866 383/906 |
| 2005/0040181 | A1 * | 2/2005 | Kurosawa | B65D 75/5883 222/92 |
| 2020/0281381 | A1 * | 9/2020 | Sorensen | A47J 43/27 |

OTHER PUBLICATIONS

International Preliminary Report on Patentability, International Patent Application No. PCT/IB2022/056400, pp. 1-5, dated Feb. 13, 2024.

* cited by examiner

MULTI-APERTURE SPILL-RESISTANT SPOUT

CROSS-REFERENCE TO RELATED APPLICATION

This application claims priority to U.S. Provisional Patent Application Ser. No. 63/260,092 filed Aug. 9, 2021, which application is hereby incorporated by reference in its entirety.

FIELD OF THE DISCLOSURE

The present disclosure is directed generally to spout systems for containers used primarily for storing and dispensing solid, liquid, or semi-liquid products such as foodstuffs, hygiene, or healthcare products. Specifically, the present disclosure is directed to spout systems and methods of making spout systems with spill-resistant aperture configurations.

BACKGROUND

Squeezable food containers, e.g., flexible pouches, typically include a spout or straw configured to facilitate access to stored foodstuffs within the body of the container. Should a user knock-over, drop, or otherwise tip the container, there is a high likelihood that upon contact with the ground or surface below the container, the foodstuffs within the container will escape or spill.

SUMMARY OF THE DISCLOSURE

The present disclosure provides a spill-resistant spout and method of injection molding a spill-resistant spout. The spill-resistant spout includes a conduit portion having an exit aperture in fluid communication with a central channel; and a seal portion having a bottom surface, the seal portion secured to the conduit portion and in fluid communication with the central channel, the bottom surface comprising at least two intake apertures configured to receive foodstuffs from a container. The use of multiple intake apertures increases the surface tension on the foodstuffs attempting to pass through the intake apertures while maintaining or increasing the total flow volume of foodstuffs through the spill-resistant spout. Additionally, the barrier qualities of the spill-resistant spout can be enhanced by providing one or more discrete layers of thermoplastic material and one or more layers of barrier material within at least one portion of the spill-resistant spout.

In one example, a spill-resistant spout is provided, the spill-resistant spout including a conduit portion having an exit aperture in fluid communication with a central channel; and a seal portion having a bottom surface, the seal portion secured to the conduit portion in fluid communication with the central channel, the bottom surface including at least two intake apertures configured to receive foodstuffs from a container.

In an aspect, the at least two intake apertures include at least one of: four circular intake apertures or seven circular intake apertures.

In an aspect, the at least two intake apertures include two circular intake apertures.

In an aspect, the at least two intake apertures include two non-circular intake apertures, wherein each of the non-circular intake apertures are selected from at least one of: oval intake apertures, rectangular intake apertures, and star-shaped intake apertures.

In an aspect, the at least two intake apertures include two bean or kidney shaped intake apertures.

In an aspect, the at least two intake apertures are radially disposed about a center point of the bottom surface at equal radial intervals about the center point.

In an aspect, the seal portion includes a first discrete layer of thermoplastic resin and a first discrete layer of barrier material.

In an aspect, the first discrete layer of thermoplastic resin is selected from at least one of: Acrylonitrile Butadiene Styrene (ABS), Acrylic, High Density Polyethylene (HDPE), Polypropylene, Polyethylene, Polystyrene, Polyvinyl Chloride (PVC), Polyethylene Terephthalate (PET), Polycarbonate, Polylactic Acid, Thermoplastic Starch, Polyhydroxyalkanoate, Polyhydroxybutyrate, Polybutylene succinate, Polyamide, cellulose fibers, cellulose nano crystals, or any combination thereof.

In an aspect, the first discrete layer of barrier material is selected from at least one of: Polyamide, Ethylene Vinyl Alcohol (EVOH), Polyvinyl Alcohol, Thermoplastic Starch, cellulose nano crystals, nano clay, or any combination thereof.

In another example, a method of injection molding a spill-resistant spout is provided, the method including: injecting a thermoplastic resin into an injection port of a mold, the mold configured to form the spill-resistant spout with a conduit portion having an exit aperture in fluid communication with a central channel; and a seal portion having a bottom surface, the seal portion secured to the conduit portion and in fluid communication with the central channel, the bottom surface comprising at least two intake apertures configured to receive foodstuffs from a container, wherein the injection port is proximate a center point of the bottom surface of the seal portion.

In an aspect, the at least two intake apertures include at least one of: four circular intake apertures or seven circular intake apertures.

In an aspect, the at least two intake apertures include two circular intake apertures.

In an aspect, the at least two intake apertures include two non-circular intake apertures, wherein each of the non-circular intake apertures are selected from at least one of: oval intake apertures, rectangular intake apertures, and star-shaped intake apertures.

In an aspect, the at least two intake apertures include two bean or kidney shaped intake apertures.

In an aspect, the at least two intake apertures are radially disposed about the center point of the bottom surface at equal radial intervals about the center point.

In an aspect, the injecting step includes injecting a first discrete layer of thermoplastic resin and a first discrete layer of barrier material.

In an aspect, the first discrete layer of thermoplastic resin is selected from at least one of: Acrylonitrile Butadiene Styrene (ABS), Acrylic, High Density Polyethylene (HDPE), Polypropylene, Polyethylene, Polystyrene, Polyvinyl Chloride (PVC), Polyethylene Terephthalate (PET), Polycarbonate, Polylactic Acid, Thermoplastic Starch, Polyhydroxyalkanoate, Polyhydroxybutyrate, Polybutylene succinate, Polyamide, cellulose fibers, cellulose nano crystals, or any combination thereof.

In an aspect, the first discrete layer of barrier material is selected from at least one of: Polyamide, Ethylene Vinyl Alcohol (EVOH), Polyvinyl Alcohol, Thermoplastic Starch, cellulose nano crystals, nano clay, or any combination thereof.

These and other aspects of the various embodiments will be apparent from and elucidated with reference to the embodiment(s) described hereinafter.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the various embodiments.

DETAILED DESCRIPTION OF EMBODIMENTS

The present disclosure provides a spill-resistant spout and method of injection molding a spill-resistant spout. The spill-resistant spout includes a conduit portion having an exit aperture in fluid communication with a central channel; and a seal portion having a bottom surface, the seal portion secured to the conduit portion and in fluid communication with the central channel, the bottom surface comprising at least two intake apertures configured to receive foodstuffs from a container. The use of multiple intake apertures increases the surface tension on the foodstuffs attempting to pass through the intake apertures while maintaining or increasing the total flow volume of foodstuffs through the spill-resistant spout. Additionally, the barrier qualities of the spill-resistant spout can be enhanced by providing one or more discrete layers of thermoplastic material and one or more layers of barrier material within at least one portion of the spill-resistant spout.

Figure 1:
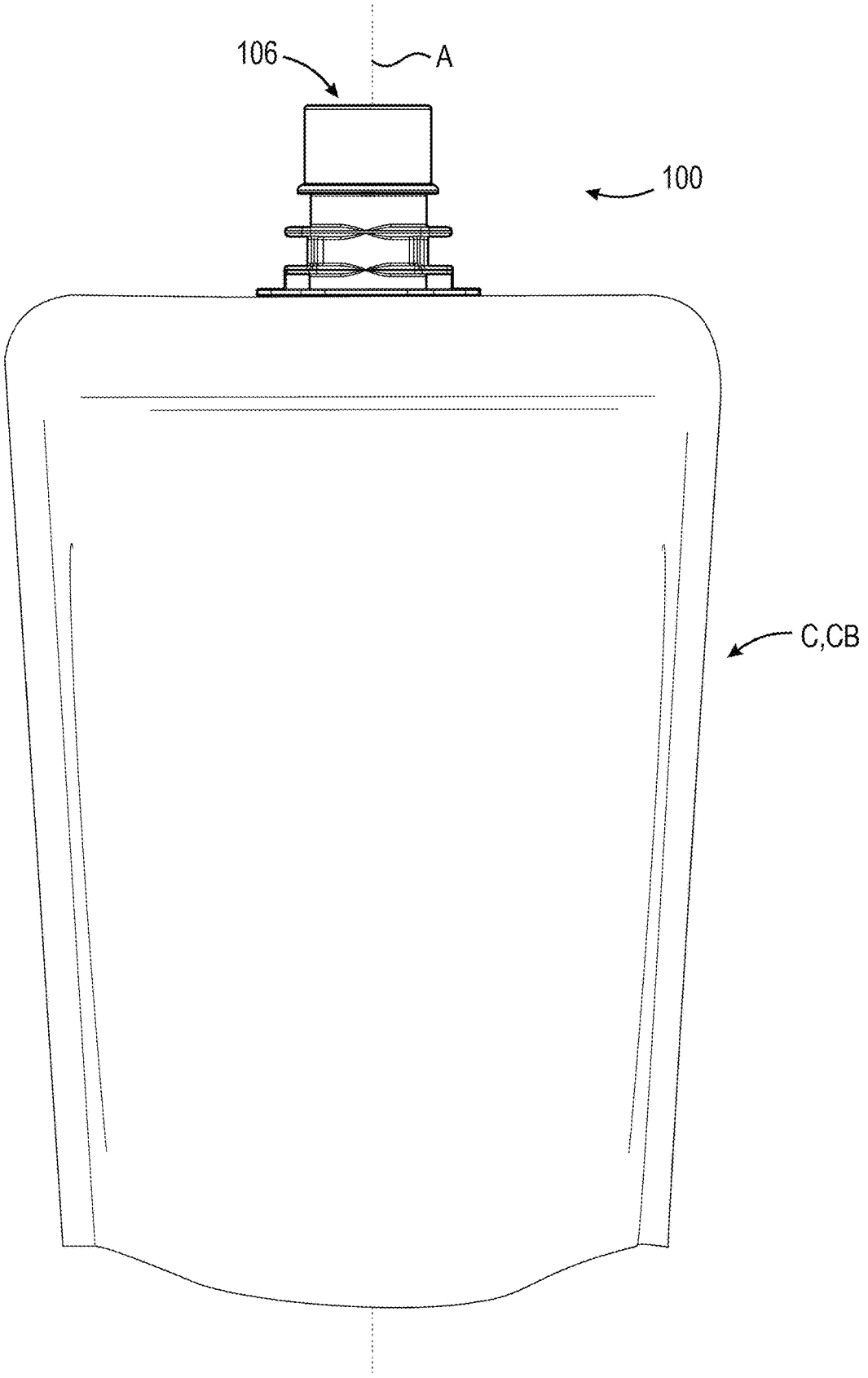
FIG. 1 is a front view of a container and spill-resistant spout according to the present disclosure.

Transitioning now to the figures, FIG. 1 illustrates a container C with a spill-resistant spout 100 according to the present disclosure. Container C is intended to be a flexible pouch, pod, flask, tetra pack, or any other container configured to receive solid, liquid, and/or semi-liquid foodstuffs. Container C can be made of paper, metal foil, and/or plastics such as polypropylene, polyethylene, or polystyrene, or any other flexible, water-resistant or water-proof material. In some examples, container C comprises a container barrier material CB or may include a discrete layer of container barrier material CB, where the container barrier material is selected from Polyamide, Ethylene Vinyl Alcohol (EVOH), Polyvinyl Alcohol, Thermoplastic Starch, cellulose nano crystals, nano clay, or any combination thereof. In some examples, container C is made of polypropylene and is configured to stand upright on a substantially planar surface without additional support. In other words, container C is intended to be made of a flexible material capable of retaining enough rigidity that it is still capable of free standing (i.e., standing without any support member). Container C is configured to store and dispense various solids, liquids, semi-fluids, liquids with solid parts, or other foodstuffs including, but not limited to yogurt, milk, baby food, or fruit or vegetable purees. As will be discussed below, container C is intended to receive a spill-resistant spout, e.g., spill-resistant spout 100, such that the spill-resistant spout 100 is configured to mitigate or eliminate egress or spillage of foodstuffs stored in container C.

As illustrated in FIGS. 2-5, spill-resistant spout 100 includes a conduit portion 102 and a seal portion 104. Conduit portion 102 is intended to be a tube, straw, or other longitudinal body with an inner volume (defined by central channel 112 shown in FIGS. 6A and 6B) configured to provide fluid communication of foodstuffs between container C and, for example, a user's mouth when engaged with conduit portion 102. It should be appreciated that the shape of conduit portion 102 is not limited to a tubular shape, e.g., having a circular cross-sectional profile. Alternatively, conduit portion 102 can have a cross-sectional profile selected from at least one of: square, hexagonal, octagonal, or oval. As used herein, and in addition to its ordinary meaning with the art, the term "fluid communication" is intended to mean the flow, movement, or transfer of a material from a first location to a second location different than the first, and can refer to the movement of solids, liquids, semi-solids, and/or liquids with solid parts from the first location to the second location. Although illustrated as a substantially tubular member, it should be appreciated that conduit portion 102 can take any substantially longitudinal shape, e.g., any shape having a first end, a second end, and a through-bore arranged between the first and second ends to provide fluid communication of foodstuffs. As shown in FIGS. 1-6B, for ease of illustration and description, conduit portion 102 is arranged about an imaginary axis A (hereinafter referred to as "axis A"), such that axis A extends through, and in examples where conduit portion 102 is tubular in shape, conduit portion 102 is concentrically centered about axis A. At the first end of conduit portion 102, conduit portion 102 includes an exit aperture 106. Exit aperture 106 is intended to be positioned within the user's mouth while the user is engaged with spill-resistant spout 100 and/or container C. As will be discussed below, conduit portion 102 also includes an internal central channel 112 shared by conduit portion 102 and seal portion 104.

Figure 2:
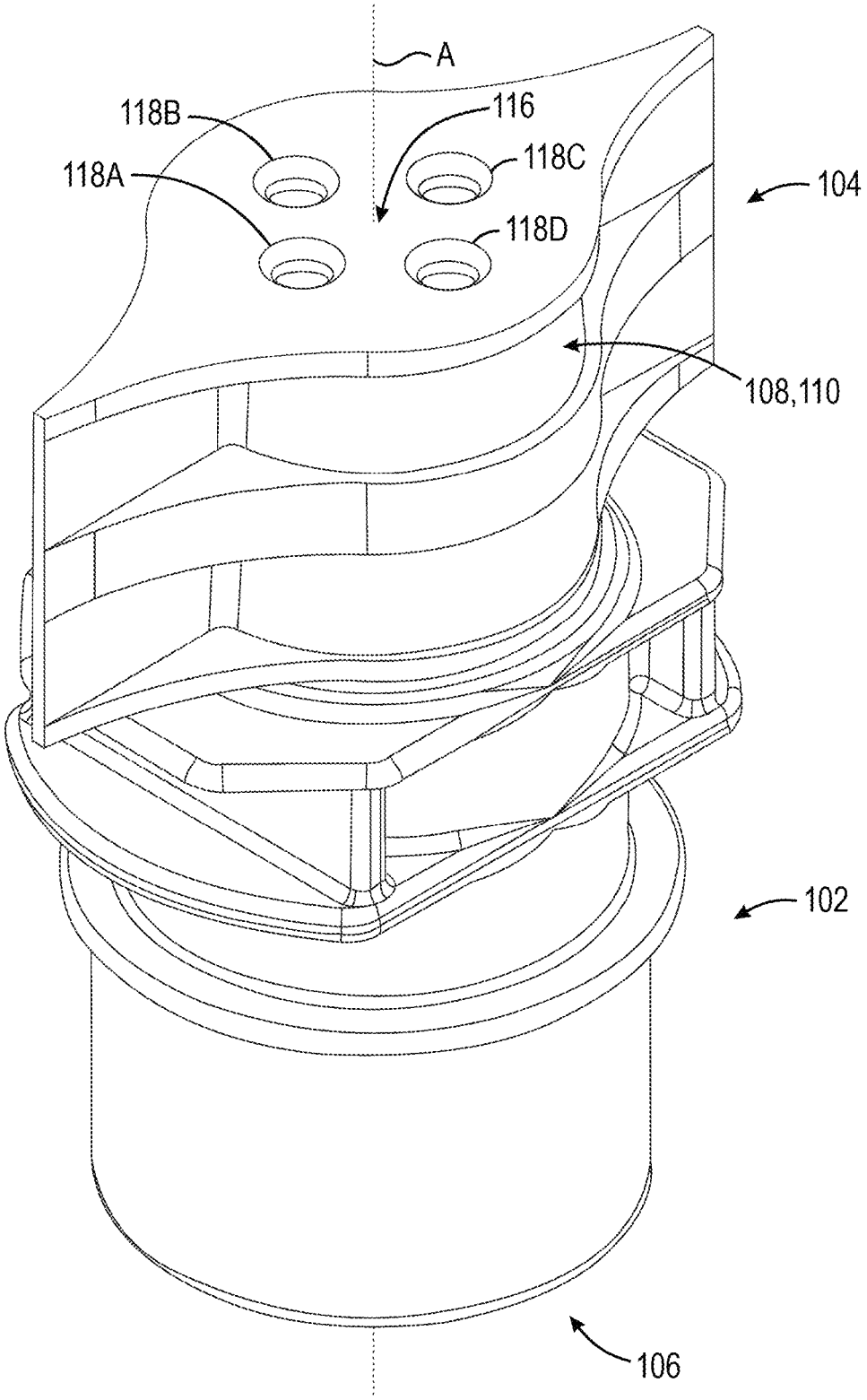
FIG. 2 is a bottom perspective view of a spill-resistant spout according to the present disclosure.
Figure 3:
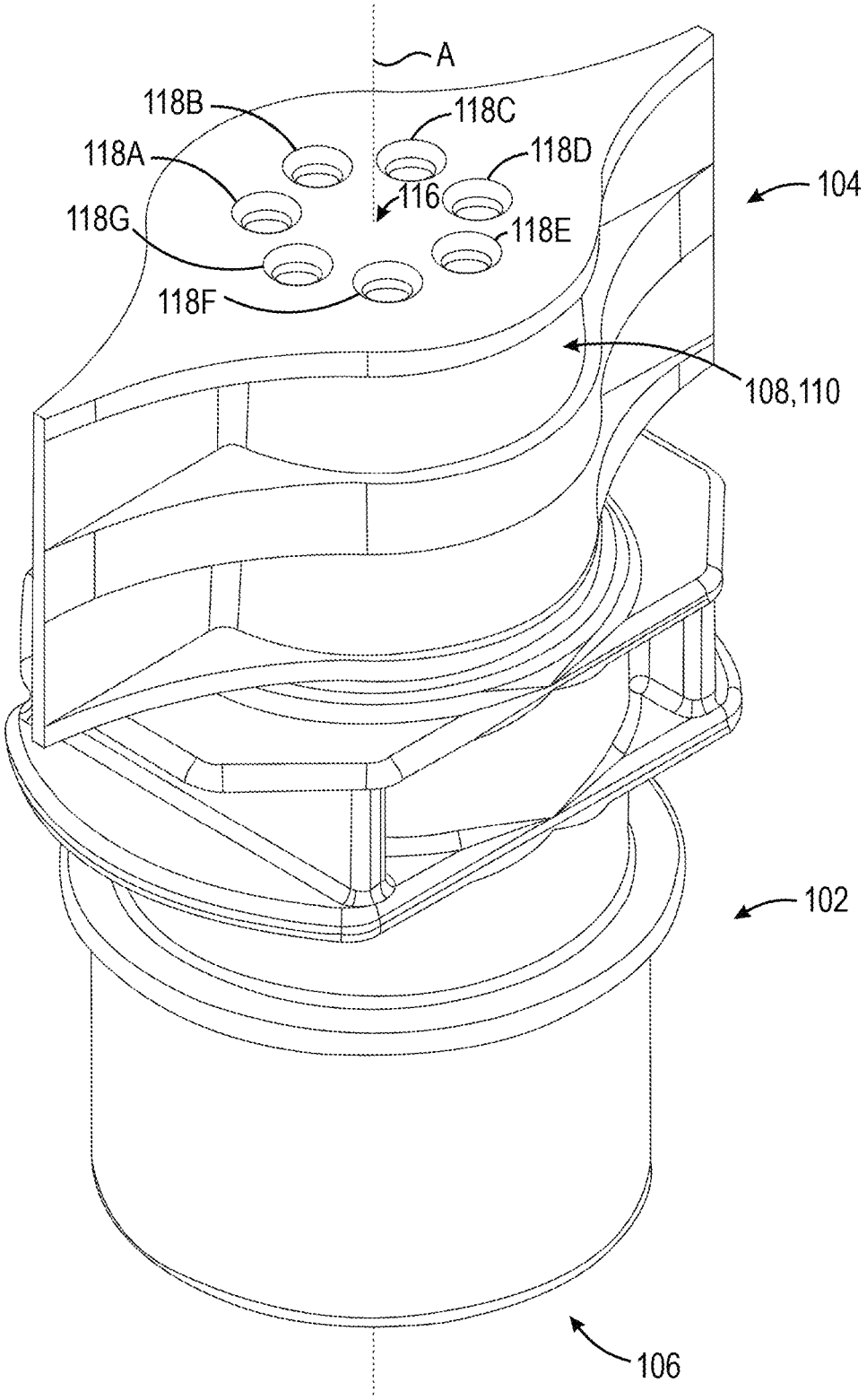
FIG. 3 is a bottom perspective view of a spill-resistant spout according to the present disclosure.
Figure 4:
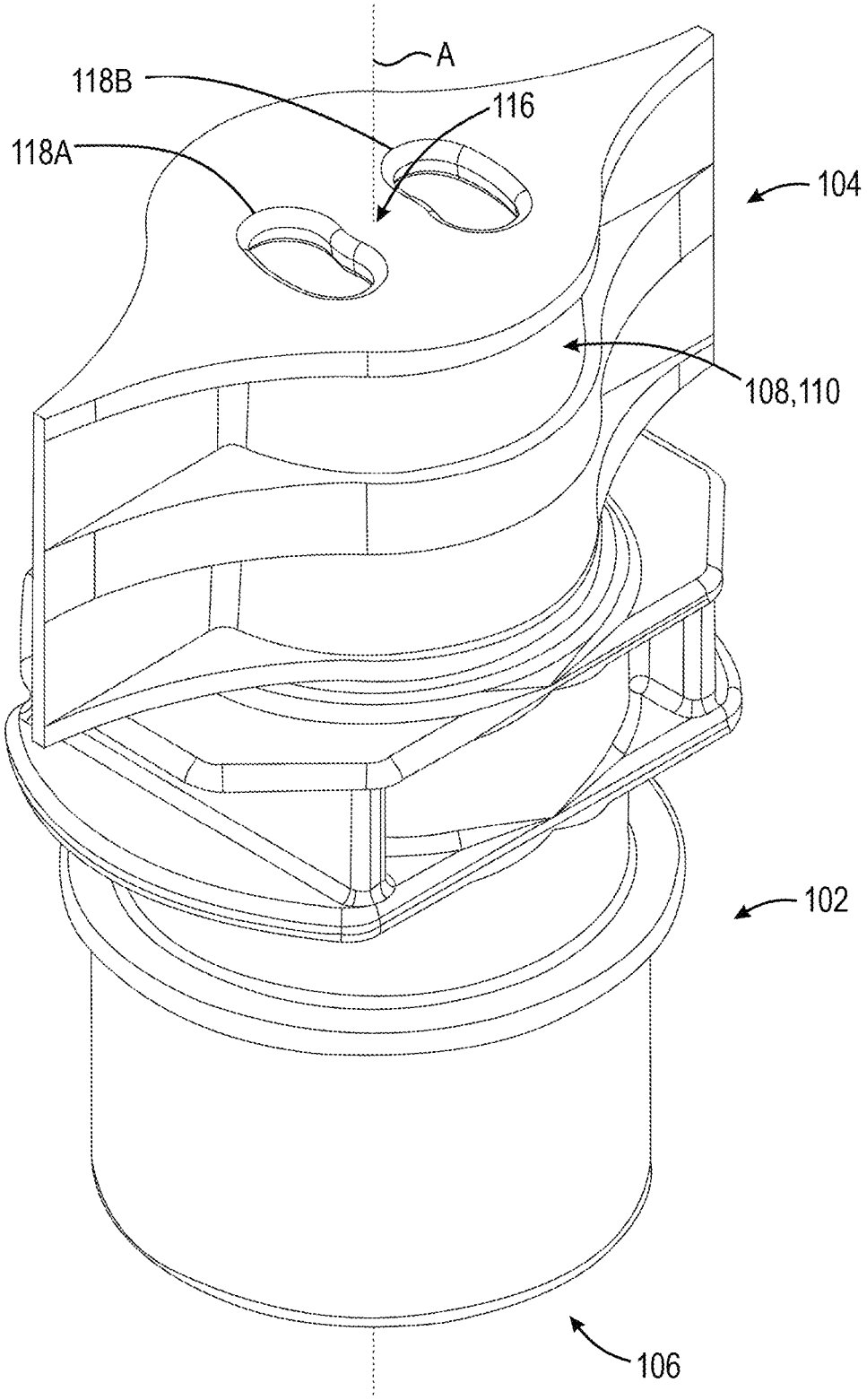
FIG. 4 is a bottom perspective view of a spill-resistant spout according to the present disclosure.

Seal portion 104 is intended to be a substantially lateral portion of spill-resistant spout 100 that is configured to receive and seal or otherwise permanently engage with the interior of container C. In some examples, seal portion 104 includes one or more surfaces 108 configured to be fixedly secured to the container C via heat sealing, conduction sealing, induction sealing, adhesive sealing, ultrasonic bonding, welding, laser sealing, or any combination thereof. As illustrated in FIGS. 2-4, the one or more surfaces 108, include an outer contour that begins at a point of convergence at one end of seal portion 104 (left side in FIGS. 2-4), expands to a maximum width and reduces back to another point of convergence at the opposing end of seal portion 104 (right side in FIGS. 2-5). This contour provides an overall shape to seal portion 104 that resembles a boat or canoe with a flat bottom. In some examples, as illustrated in FIGS. 2-4, the one or more surfaces 108 can each include one or more laterally disposed grooves 110 configured to provide additional surface area and increase overall adhesion between the inner surface of container C and the seal portion 104 of spill-resistant spout 100.

In some examples, as illustrated in FIGS. 1-6B, conduit portion 102 and seal portion 104 are intended to be formed as a single integral body where conduit portion 102 and seal portion 104 are both arranged concentrically about axis A. In these examples, spill-resistant spout 100 includes an internal central channel 112 (shown in FIGS. 6A and 6B) that begins at the first end of conduit portion 102 proximate exit aperture 106 and terminates at a bottom surface 114 of seal portion 104. In other words, central channel 112 extends through conduit portion 102 and seal portion 104 and terminates at a bottom surface 114 of seal portion 104. It should be appreciated that, in some examples, central channel 112 is tubular shaped, e.g., has a circular cross-sectional profile; however, in further examples, central channel 112 can be formed with a cross-sectional profile that matches the cross-sectional profile of exit aperture 106, e.g., a cross-sectional profile selected from at least one of: square, hexagonal, octagonal, or oval. Additionally, and although not illustrated, it should be appreciated that conduit portion 102 and seal portion 104 can be created as separate and discrete portions, e.g., in two separate injection molding processes (discussed below), and can be secured together prior to engagement with the user by any suitable fastening means.

As illustrated in FIGS. 2-5, which illustrate three example embodiments of spill-resistant spout 100, respectively, bottom surface 114 is intended to be a substantially planar surface that is flush with the bottom-most surface (top-most in the inverted illustration shown in FIGS. 2-5) of seal portion 104. In some examples, bottom surface 114 includes a conceptual center point 116 that is concentric with central channel 112 of spill-resistant spout 100 and positioned such that axis A passes directly through the conceptual center point 116. In the examples illustrated, bottom surface 114 of spill-resistant spout 100 includes a plurality of intake apertures 118. As shown in FIG. 2, which illustrates a bottom perspective view of spill-resistant spout 100 according to the present disclosure, bottom surface 114 includes four intake apertures 118A-118D (collectively referred to herein as "plurality of apertures 118"). Each intake aperture 118 shown is circularly shaped and disposed in an equal radial distribution about central point 116. For example, each intake aperture 118 of the four intake apertures 118A-118D is equally spaced and positioned every 90 degrees from each other about central point 116. It should be appreciated that the size of the apertures disposed on bottom surface 114 directly can be adjusted based on the viscosity of the product (foodstuffs) stored within container C. For example, the higher the viscosity of the foodstuffs for a particular application, the larger the apertures need to be to allow a flow of the product into the user's mouth. Conversely, the lower the viscosity of the foodstuffs for a particular application, the smaller the apertures can be while still providing an optimal flow of the foodstuffs into the user's mouth. Additionally, the apertures 118 can be positioned or located at various locations on bottom surface 114. In some examples, apertures 118 can be located anywhere on bottom surface 114 that does not conflict with the location of central point 116 (e.g., where the injection molding port/gate will be located during the injection molding process, discussed below). For example, the injection molding gate may require approximately a 1 mm diameter area at the central point 116 of bottom surface 114, which means that the apertures 118 can be placed anywhere on bottom surface 118 that does not interfere with a 1 mm diameter portion proximate central point 116. It should also be appreciated that as injection molding technology advances the 1 mm portion may decrease in size. Additionally, a central location for the injection molding port/gate is not required. The size, position, and number of apertures 118 can also vary based on the filling system used.

FIG. 3, which illustrates a bottom perspective view of another example embodiment of spill-resistant spout 100 according to the present disclosure, shows a bottom surface 114 that includes seven intake apertures 118A-118G (collectively referred to herein as "plurality of apertures 118"). Each intake aperture 118 shown is circularly shaped and disposed in an equal radial distribution about central point 116. For example, each intake aperture 118 of the seven intake apertures 118A-118G is equally spaced and positioned approximately every 51.43 degrees from each other about central point 116.

FIG. 4, which illustrates a bottom perspective view of a further example embodiment of spill-resistant spout 100 according to the present disclosure, shows a bottom surface 114 that includes two intake apertures 118A-118B (collectively referred to herein as "plurality of apertures 118"). Each intake aperture 118 shown is kidney or bean shaped and disposed in an equal radial distribution about central point 116. For example, each intake aperture 118 of the two kidney-shaped intake apertures 118A-118B are equally spaced and positioned 180 degrees from each other about central point 116.

Figure 5:
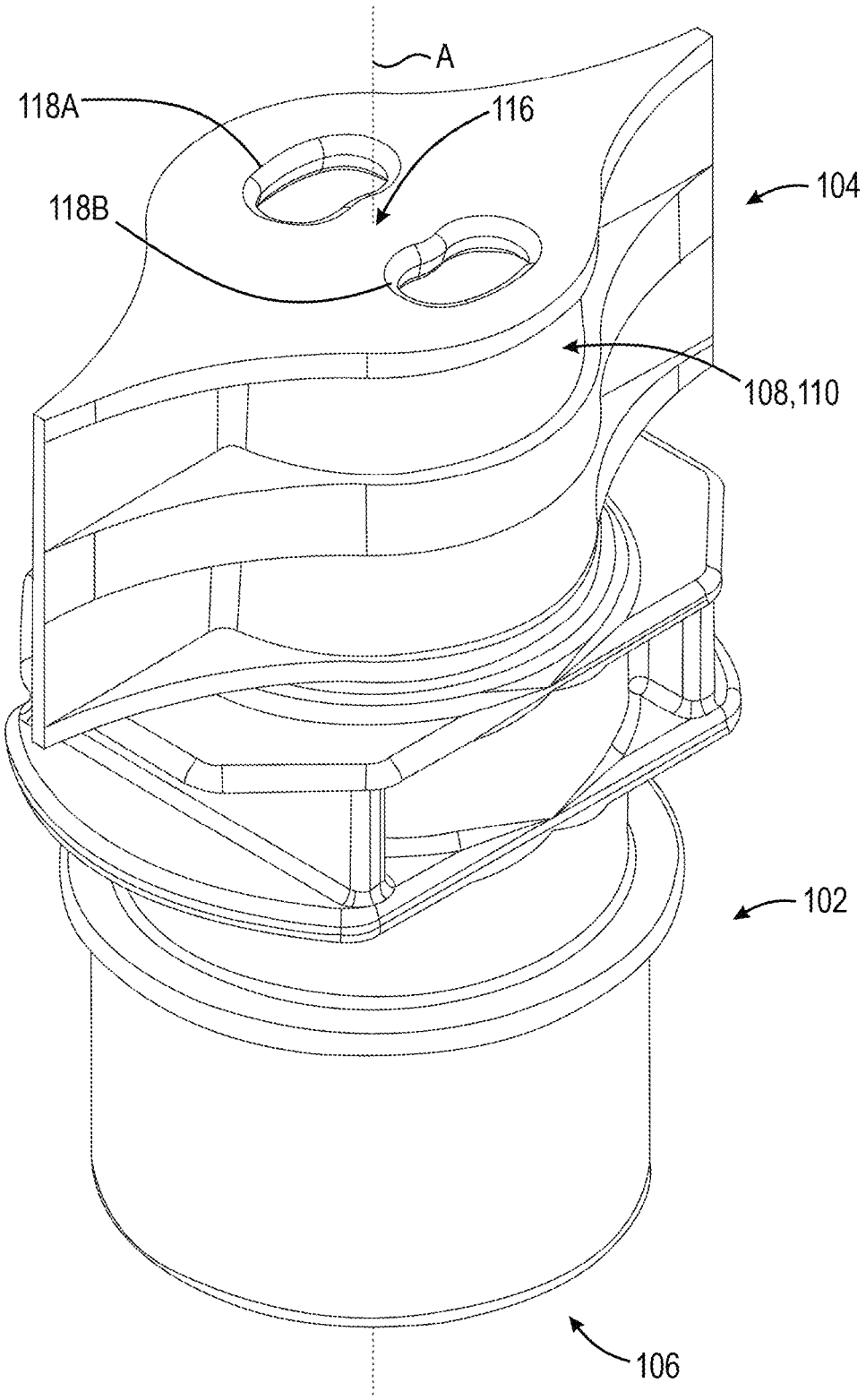
FIG. 5 is a bottom perspective view of a spill-resistant spout according to the present disclosure.

FIG. 5, which illustrates a bottom perspective view of another example embodiment of spill-resistant spout 100 according to the present disclosure, shows a bottom surface 114 that includes two intake apertures 118A-118B (collectively referred to herein as "plurality of apertures 118"). Each intake aperture 118 shown is kidney or bean shaped and disposed in an equal radial distribution about central point 116. For example, each intake aperture 118 of the two kidney-shaped intake apertures 118A-118B are equally spaced and positioned 180 degrees from each other about central point 116. The example embodiment shown in FIG. 5 differs from that shown in FIG. 4 in that the plurality of apertures 118 have been rotated 90 degrees relative to the central point 116. This configuration improves the laminar flow F (discussed below with respect to FIG. 8) of the injection molded materials.

Although not illustrated, other quantities and shapes of intake apertures 118 are contemplated herein. For example, bottom surface 114 can include 2, 3, 4, 5, 10, 15, 20, intake apertures 118 configured to receive foodstuffs from an internal cavity within container C. Additionally, the intake apertures can be circular, square, rectangular, hexagonal, octagonal, star-shaped etc.

In some examples, both conduit portion 102 and seal portion 104, are made from a thermoplastic resin material 120 selected from at least one of: Acrylonitrile Butadiene Styrene (ABS), Acrylic, High Density Polyethylene (HDPE), Polypropylene, Polyethylene, Polystyrene, Polyvinyl Chloride (PVC), Polyethylene Terephthalate (PET), Polycarbonate, Polylactic Acid, Thermoplastic Starch, Polyhydroxyalkanoate, Polyhydroxybutyrate, Polybutylene succinate, Polyamide, cellulose fibers, cellulose nano crystals, or any combination thereof. As will be discussed below, in some examples, conduit portion 102 and seal portion 104 may include one or more discrete layers of thermoplastic resin material 120 and/or one or more layers of barrier material 122 (e.g., first discrete layer of thermoplastic resin material 124 and first discrete layer of barrier material 126).

Figure 6A:
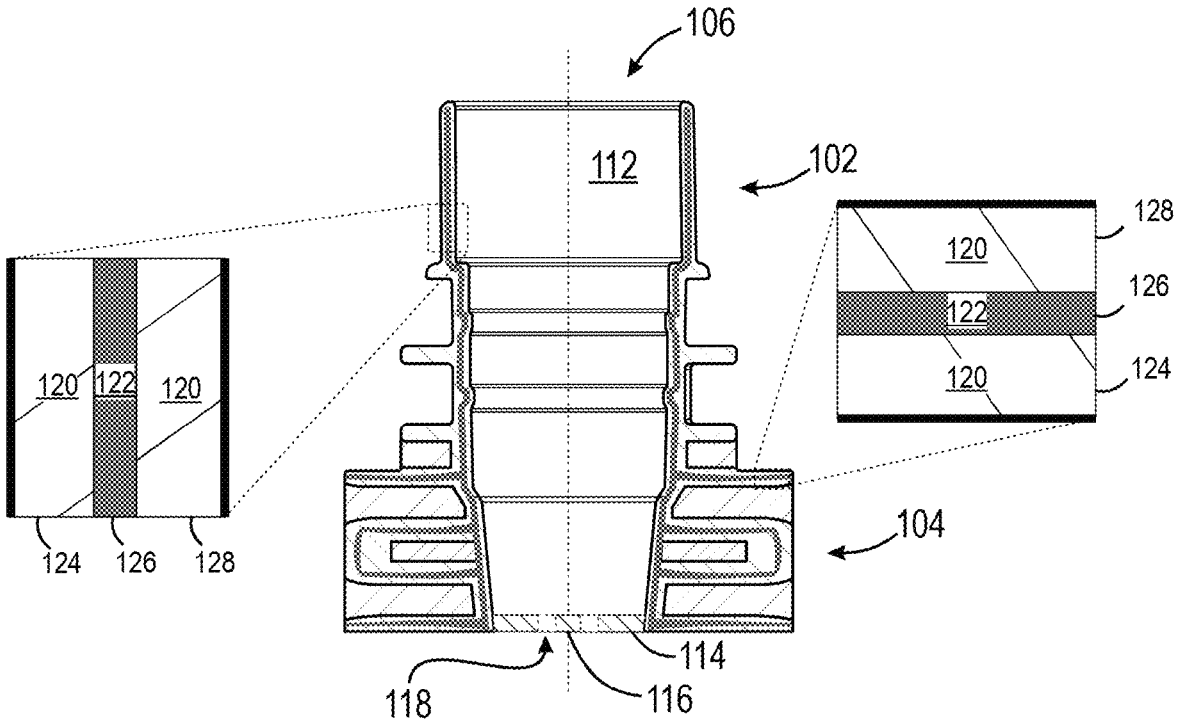
FIG. 6A is cross-sectional view of a spill-resistant spout according to the present disclosure.
Figure 6B:
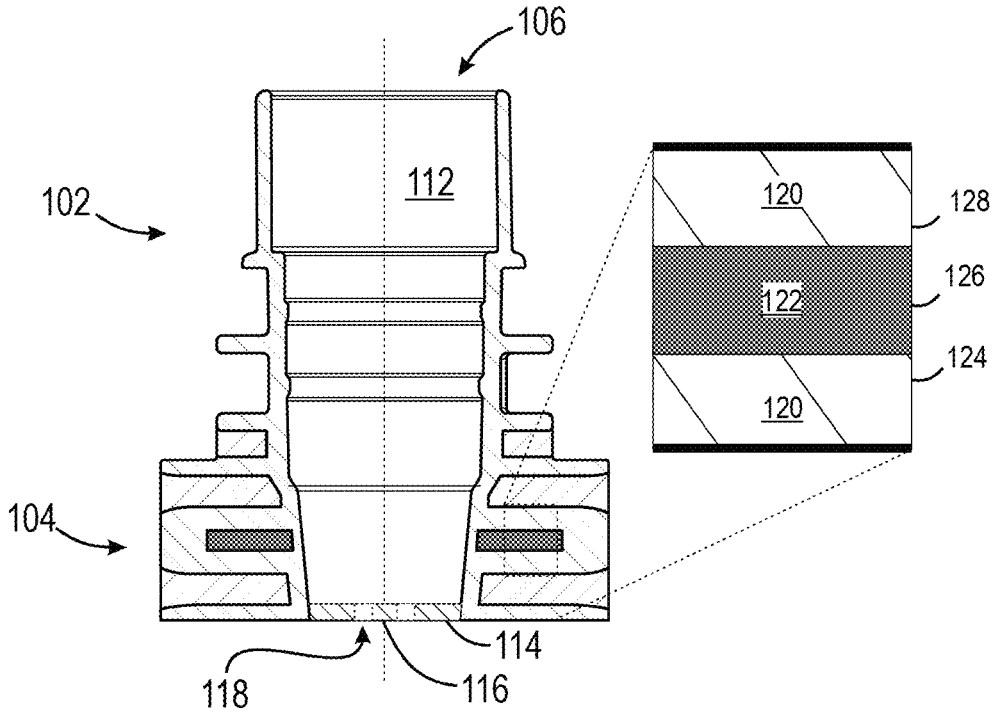
FIG. 6B is cross-sectional view of a spill-resistant spout according to the present disclosure.

FIGS. 6A-6B illustrate cross-sectional views of spill-resistant spout 100 taken generally along a plane shared by axis A and arranged to pass through the longer dimension of seal portion 104, e.g., wings W (discussed below). As shown, conduit portion 102 and seal portion 104 are intended to be formed and co-extruded to include one or more discrete layers of thermoplastic resin material 120 and one or more discrete layers of a barrier material 122. As used herein, and in addition to its ordinary meaning to those in the art, the term "discrete" is intended to mean individually distinct, e.g., two discrete layers are intended to refer to a first layer and a second layer where the materials of the first layer and the materials of the second layer are potentially individually distinct from each other. Although these layers may contact each other, each layer is individually distinct from another discrete layer. As discussed above, the one or more discrete layers of thermoplastic resin material 120 can be selected from at least one of: Acrylonitrile Butadiene Styrene (ABS), Acrylic, High Density Polyethylene (HDPE), Polypropylene, Polyethylene, Polystyrene, Polyvinyl Chloride (PVC), Polyethylene Terephthalate (PET), Polycarbonate, Polylactic Acid, Thermoplastic Starch, Polyhydroxyalkanoate, Polyhydroxybutyrate, Polybutylene succinate, Polyamide, cellulose fibers, cellulose nano crystals, or a combination of any of the foregoing materials. Additionally, the one or more discrete layers of barrier material 122 discussed herein can be selected from at least one of: Polyamide, Ethylene Vinyl Alcohol (EVOH), Polyvinyl Alcohol, Thermoplastic Starch, cellulose nano crystals, nano clay, or any combination thereof. As will be discussed below, in some examples, a barrier layer is provided within only the seal portion 104, while in other examples, a barrier layer is provided in seal portion 104 and conduit portion 102. In all examples, the one or more discrete layers of barrier material are intended to hinder, and in some cases entirely prevent, the migration of external substances, e.g., oxygen or moisture, from entering spill-resistant spout 100 and/or container C and spoiling or otherwise altering the foodstuffs stored within container C.

In some examples as illustrated in FIG. 6A, both the conduit portion 102 and the seal portion 104 include one or more discrete layers of thermoplastic material 120 and at least one discrete layer of barrier material 122. As shown, spill-resistant spout 100 includes a first discrete layer of thermoplastic material 124, a first discrete layer of barrier material 126, and a second discrete layer of thermoplastic material 128. It should be appreciated that first discrete layer of thermoplastic material 124 and second discrete layer of thermoplastic material 128 can be made of one or more of the thermoplastic materials 120 discussed above. It should also be appreciated that the first discrete layer of barrier material 126 can be made of one or more of the barrier materials 122 discussed above.

In other examples, as shown in FIG. 6B, one or more discrete layers of barrier material, e.g., first discrete layer of barrier material 126, can be disposed within only seal portion 104 of spill-resistant spout 100. First discrete layer of barrier material 126, as illustrated, is arranged as one or more flat or planar layers of barrier material 122 disposed substantially parallel with bottom surface 114. As illustrated, the rest of spill-resistant spout, e.g., conduit portion 102 and the rest of seal portion 104 are free from barrier materials 122. However, it should be appreciated that, in some examples, conduit portion 102 and/or the rest of seal portion 104 can include additional barrier material 122 that is blended or mixed with the thermoplastic resin material 120 to form a uniformly blended material.

Figure 7:
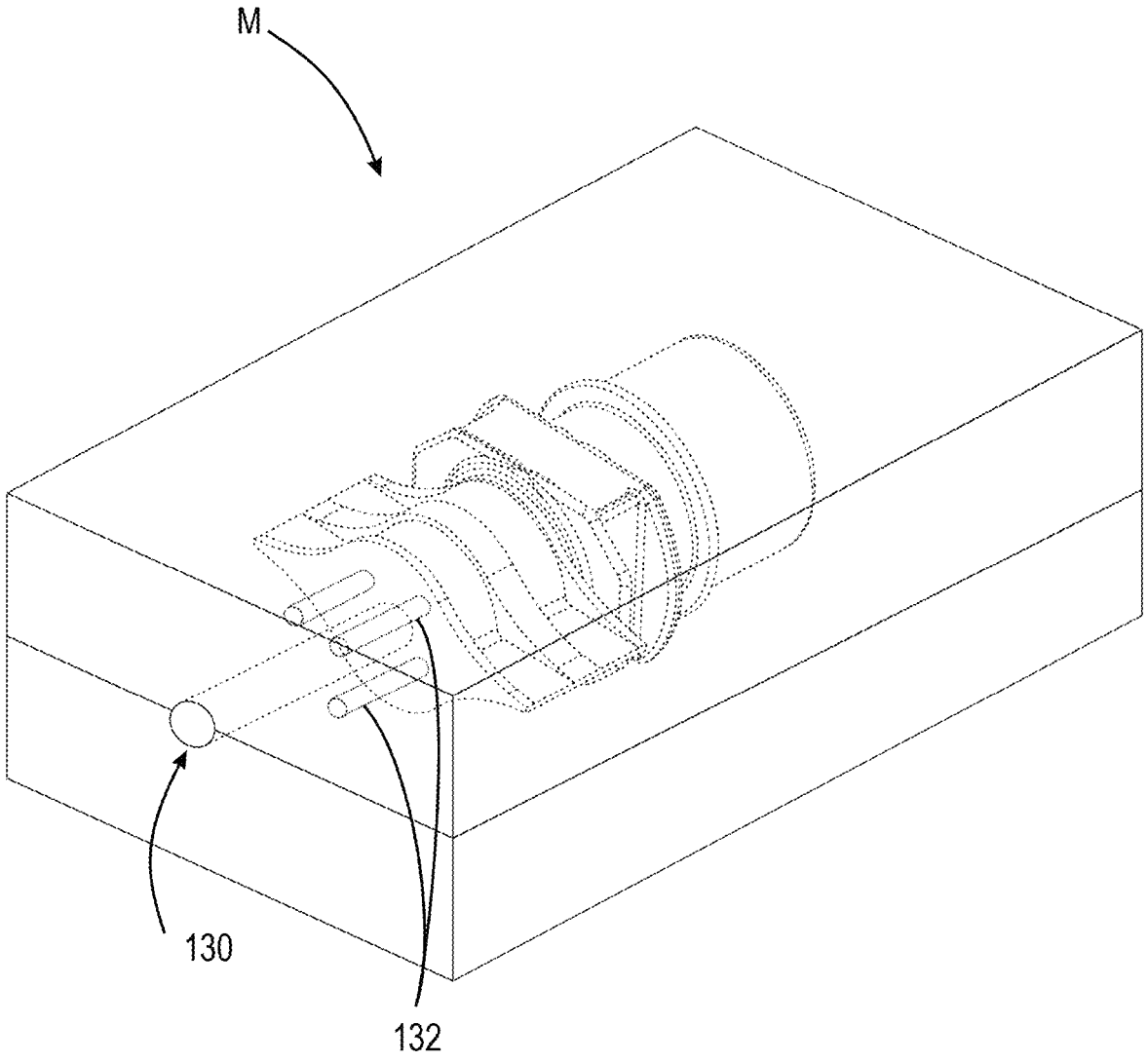
FIG. 7 is schematic perspective view of an injection mold according to the present disclosure.

FIG. 7 illustrates one example embodiment of an injection mold M according to the present disclosure. As shown, the mold M can include two halves, i.e., a top half and a bottom half configured to matingly engage and align during an injection molding process. Both halves of mold M can include a cavity that is formed as a partial negative impression of the spill-resistant spout 100 to be molded. Additionally, and although not illustrated, the negative cavity may have an inner mold body that acts as the negative shape of central channel 112. As illustrated, mold M can also include one or more injection ports 130 configured to receive a molten form of thermoplastic material 120 and/or a molten form of barrier material 122 as discussed above, and provide these materials to the negative cavity for forming the spill-resistant spout 100. In other words, as the materials are injected within the mold M, the negative space between the mold halves and the inner mold body will produce the spill-resistant spout 100 discussed herein. The one or more injection ports 130 are located substantially concentric with axis A such that the molten materials provided enter the negative cavity within mold M at the ultimate location of center point 116 of the molded spill-resistant spout 100. Said another way, once the molten material has solidified following the injection molding process, the one or more injection ports 130 will terminate at center point 116 of bottom surface 114 of spill-resistant spout 100. As such, during the injection molding process the center point 116 operates as a point of origin for the introduction of molten materials within the negative cavity of mold M. Additionally, as shown in FIG. 6, both halves of mold M can include one or more protrusions or mold posts 132. Mold posts 132 can be secured to and protrude from one or more inner walls of the mold M and/or are secured to the inner mold body that forms center channel 112. Mold posts 132 operate to prevent the molten materials injected into mold M from curing in the shape and locations of the intake apertures 118 discussed above. As such, and although illustrated as tubular posts, the mold posts 132 can be elongated members that have a circular, square, rectangular, hexagonal, octagonal, or kidney or bean shaped cross sectional profile, or any shape corresponding to the shape of intake apertures 118.

Figure 8:
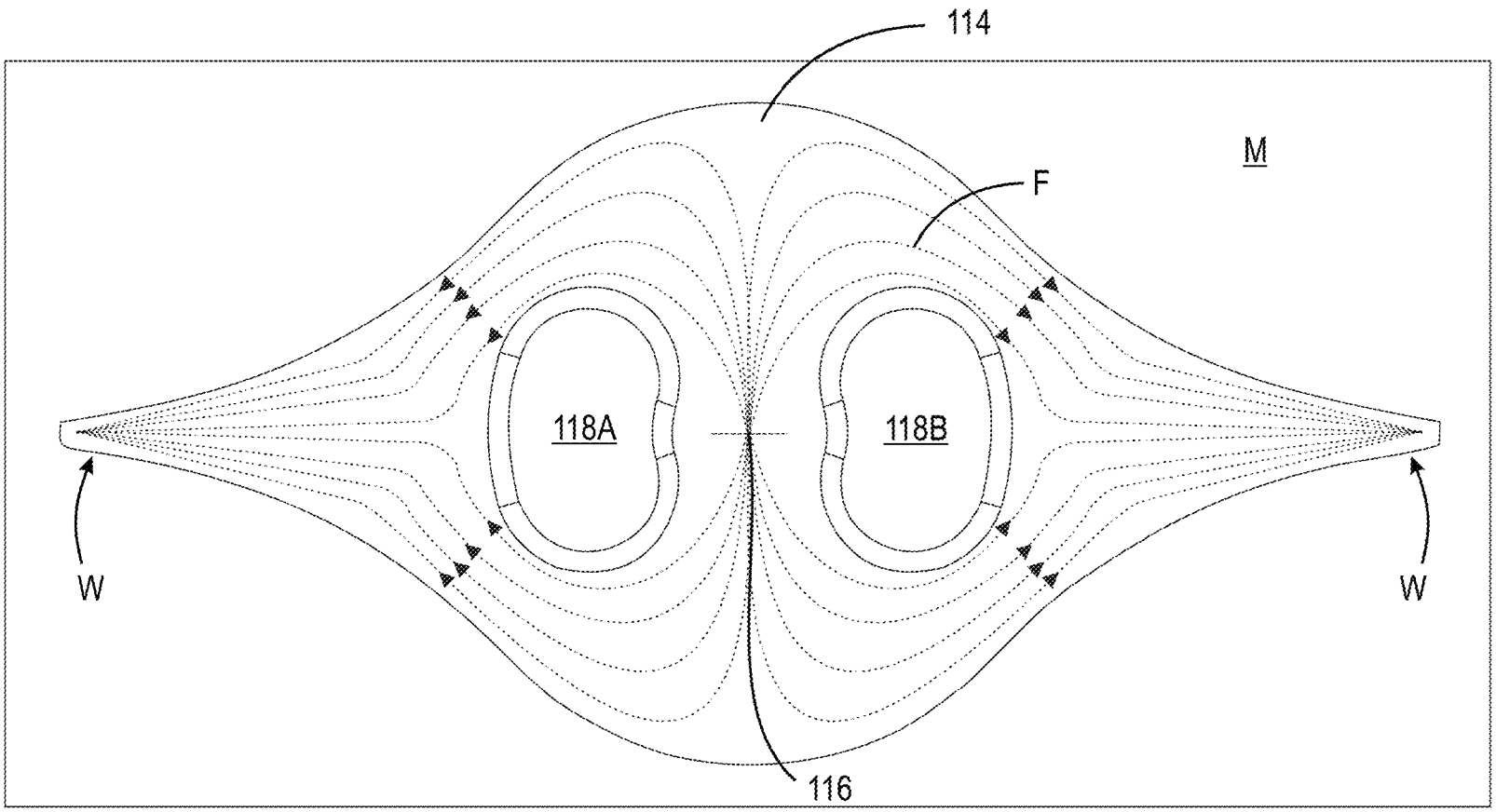
FIG. 8 is schematic side elevational view of an injection mold according to the present disclosure.

FIG. 8 illustrates a schematic side elevational view of mold M and the direction of a flow F of molten materials during the injection molding process. As illustrated, the molten materials are introduced within the negative cavity within mold M via one or more injection ports 130 (shown in FIG. 7). The injection port 130 is substantially aligned with central point 116 such that the molten materials injected enter the negative cavity within mold M at the ultimate location of center point 116 of the molded spill-resistant spout 100. As such, during the injection molding process the center point 116 operates as a point of origin for the introduction of molten materials within the negative cavity of mold M. FIG. 8 illustrates a plurality of exemplary flow paths, shown as dashed lines with arrows illustrating exemplary flow F that originates at central point 116 of bottom surface 114 of spill-resistant spout 100 and proceeds around intake apertures 118 and ultimately terminating proximate the edges of wings W of seal portion 104. In the example shown in FIG. 8, the kidney or bean shaped intake apertures 118A-118B facilitate the flow F of the molten material around the apertures and toward the edges of wings W of the seal portion 104. Thus, by providing the intake apertures in a kidney or bean shape, the flow is influenced and biased toward the edges of wings W. This optimal flow pattern allows for the injection of and planar distribution of, for example, barrier materials 122, such that a discrete layer of barrier material 122 can be positioned along the longer axis of seal portion 104 (e.g., along a plane that passes through both wings W).

Figure 9:
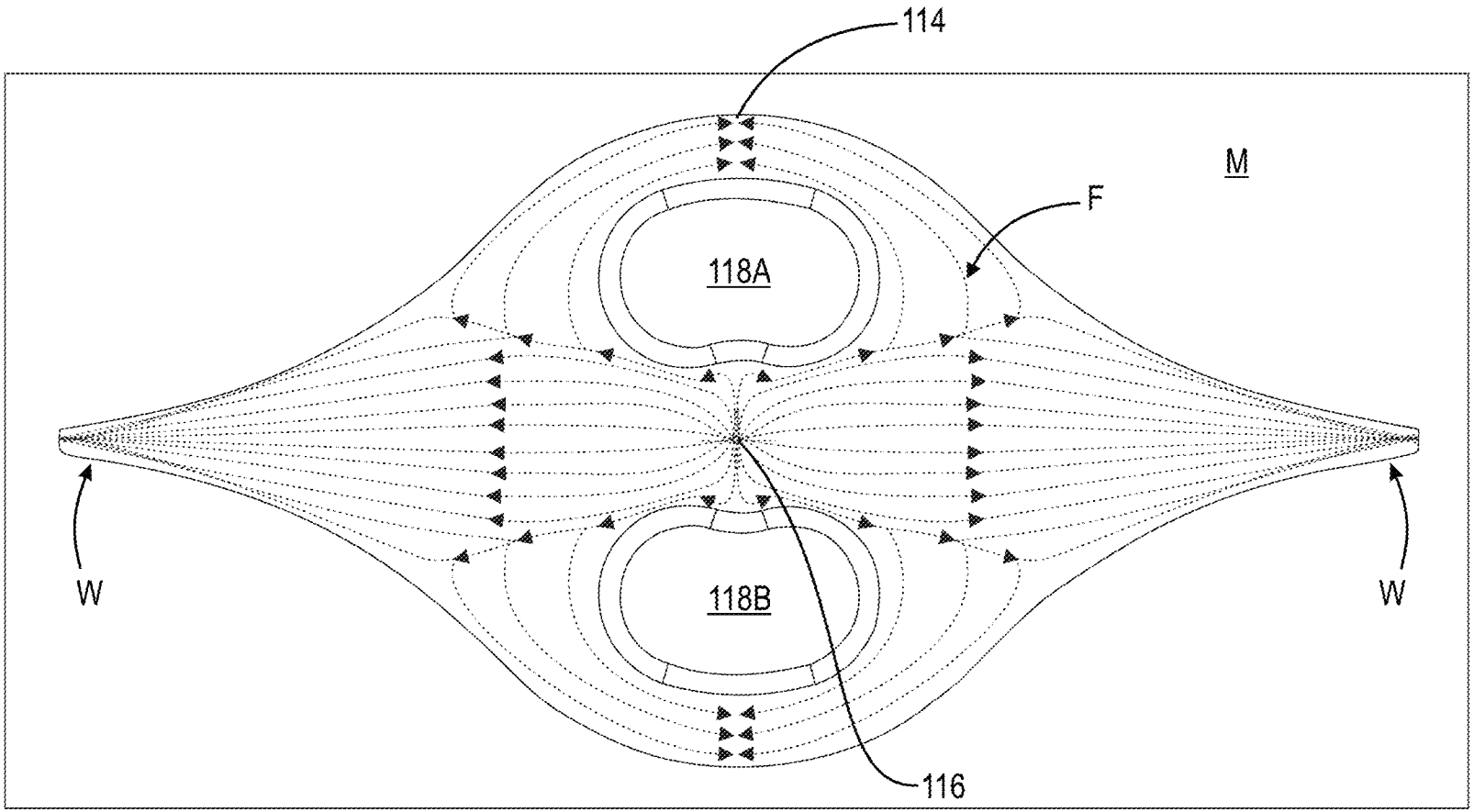
FIG. 9 is schematic side elevational view of an injection mold according to the present disclosure.

FIG. 9 illustrates a schematic side elevational view of mold M and the direction of a flow F of molten materials during the injection molding process. The example provided in FIG. 9 differs from that of FIG. 8 in that the plurality of apertures 118 have been rotated 90 degrees with respect to central point 116. As illustrated, the molten materials are introduced within the negative cavity within mold M via one or more injection ports 130 (shown in FIG. 7). The injection port 130 is substantially aligned with central point 116 such that the molten materials injected enter the negative cavity within mold M at the ultimate location of center point 116 of the molded spill-resistant spout 100. As such, during the injection molding process the center point 116 operates as a point of origin for the introduction of molten materials within the negative cavity of mold M. FIG. 9 illustrates a plurality of exemplary flow paths, shown as dashed lines with arrows illustrating exemplary flow F that originates at central point 116 of bottom surface 114 of spill-resistant spout 100 and proceeds around intake apertures 118 and ultimately terminating proximate the edges of wings W of seal portion 104. In the example shown in FIG. 9, the kidney or bean shaped intake apertures 118A-118B facilitate the flow F of the molten material directly toward the edges of wings W of the seal portion 104. Thus, by providing the intake apertures in a kidney or bean shape where the apertures are out of the way of the path between the central point 116 and the winds W, the flow is more readily biased toward the edges of wings W with little resistance. This optimal flow pattern allows for the injection of and planar distribution of, for example, barrier materials 122, such that a discrete layer of barrier material 122 can be positioned along the longer axis of seal portion 104 (e.g., along a plane that passes through both wings W).

As discussed above, the foregoing exemplary systems and methods produce a spill-resistant spout 100 with improved spill resistance. By providing a bottom surface 114 of seal portion 104, rather than leaving central channel 112 as a complete through bore, the amount of foodstuffs (e.g., liquid, solids, or otherwise), that is allowed to pass through central channel 112 can be reduced. By providing a plurality of intake apertures 118 rather than, for example, one large intake aperture, the amount of surface tension on the foodstuffs proximate bottom surface 114 is increased, thereby increasing the spill-resistance of the foodstuffs from spill-resistant spout 100. With a single larger aperture, the surface tension of the foodstuffs passing through the single larger aperture is relatively weak, leading to a weak retention force acting on the foodstuffs within an example container. Should a user knock over, drop, or otherwise tip or spill the container, the weak retention force acting on the foodstuffs stored within the container can be insufficient to retain the majority of the foodstuffs and prevent them from exiting the spout. By increasing the number of intake apertures from, for example, one to four or one to seven, the surface tension of each individual intake aperture is greater than the surface tension of a single aperture, while still allowing for the same and/or greater flow volume of foodstuffs to pass through the spill-resistant spout 100.

Additionally, in examples where the spill-resistant spout 100 is injection molded, the shapes, positions, and quantities of intake apertures 118 will facilitate, influence, and bias the molten flow F of materials within an injection mold M so as to evenly distribute, along the longer axis of the seal portion 104, discrete layers of thermoplastic material 120 or barrier material 122. By shaping intake apertures 118 as kidney or bean shaped apertures, the flow F of the molten material is guided along the exterior walls of the seal portion 104 and terminate at the wings W of seal portion 104 forming a substantially planar layer of material therewith.

Additionally, by providing a discrete layer of barrier material in one or more of the components discussed above or within only a portion of the one or more components discussed above, e.g., in conduit portion 102 or seal portion 104, spill-resistant spout 100 provides superior mitigation of migration of oxygen while reducing the amount of barrier material required to prevent said migration. Initial observations have revealed that approximately half of the oxygen migration from outside of container C to inside of container C is allowed by typical spouts or straws. Thus, by providing a discrete layer of barrier material substantially parallel with bottom surface 114 or substantially orthogonal to axis A, this migration is significantly reduced and/or eliminated.

Figure 10:
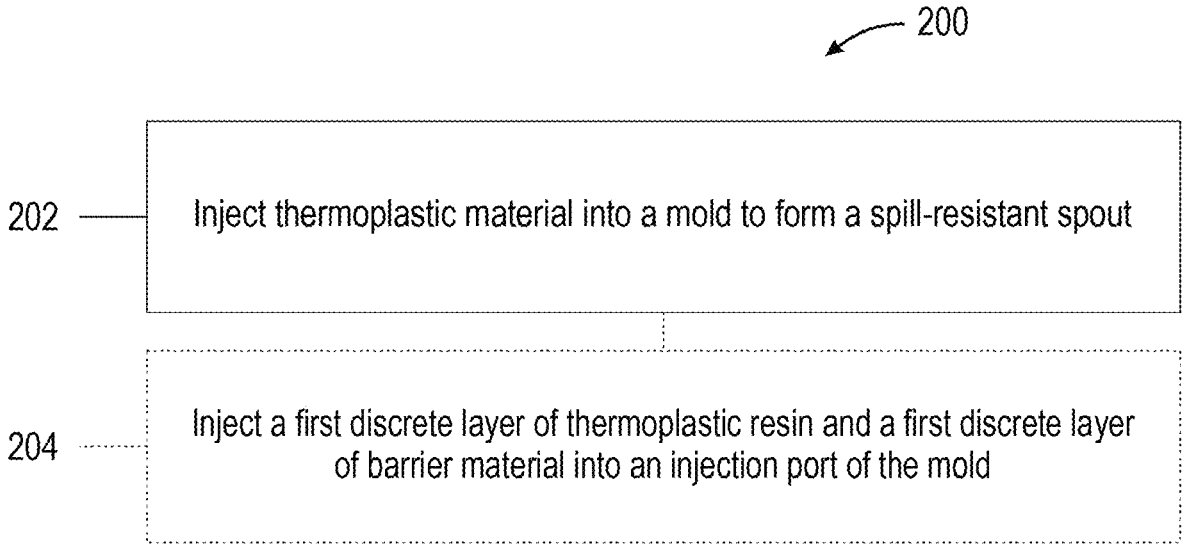
FIG. 10 shows the steps of an exemplary method according to the present disclosure.

FIG. 10, illustrates exemplary steps of a method 200 of injection molding a spill-resistant spout according to the present disclosure. As shown, method 200 includes, for example: injecting a thermoplastic resin 120 into an injection port 130 of a mold M, the mold M configured to form the spill-resistant spout 100 with a conduit portion 102 having an exit aperture 106 in fluid communication with a central channel 112; and a seal portion 104 having a bottom surface 114, the seal portion 104 secured to the conduit portion 102 and in fluid communication with the central channel 112, the bottom surface 114 comprising at least two intake apertures 118 configured to receive foodstuffs from a container C (step 202) wherein the injection port 130 is proximate a center point 116 of the bottom surface 114 of the seal portion 104. In some examples, the method includes injecting a first discrete layer of thermoplastic resin 124 and a first discrete layer of barrier material 126 into the injection port 130 of the mold M.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

What is claimed is:

1. A spill-resistant spout comprising:

a conduit portion having an exit aperture in fluid communication with a central channel; and a seal portion having a bottom surface, the seal portion secured to the conduit portion and in fluid communication with the central channel, the bottom surface comprising at least two intake apertures configured to receive foodstuffs from a container, wherein the seal portion is configured to permanently engage with the container, wherein the at least two intake apertures are integrally formed in the bottom surface, and wherein one or more side surfaces of the seal portion are configured to permanently engage with the container.

2. The spill-resistant spout of claim 1, wherein the at least two intake apertures comprise at least one of: four circular intake apertures or seven circular intake apertures.

3. The spill-resistant spout of claim 1, wherein the at least two intake apertures comprise two circular intake apertures.

4. The spill-resistant spout of claim 1, wherein the at least two intake apertures comprise two non-circular intake apertures, wherein each of the non-circular intake apertures are selected from at least one of: oval intake apertures, rectangular intake apertures, and star-shaped intake apertures.

5. The spill-resistant spout of claim 1, wherein the at least two intake apertures comprise two bean or kidney shaped intake apertures.

6. The spill-resistant spout of claim 1, wherein the at least two intake apertures are radially disposed about a center point of the bottom surface at equal radial intervals about the center point.

7. The spill-resistant spout of claim 1, wherein the seal portion includes a first discrete layer of thermoplastic resin and a first discrete layer of barrier material, wherein at least a portion of the first discrete layer of barrier material is arranged along and within the bottom surface of the seal portion.

8. The spill-resistant spout of claim 7, wherein the first discrete layer of thermoplastic resin is selected from at least one of: Acrylonitrile Butadiene Styrene (ABS), Acrylic, High Density Polyethylene (HDPE), Polypropylene, Polyethylene, Polystyrene, Polyvinyl Chloride (PVC), Polyethylene Terephthalate (PET), Polycarbonate, Polylactic Acid, Thermoplastic Starch, Polyhydroxyalkanoate, Polyhydroxybutyrate, Polybutylene succinate, Polyamide, cellulose fibers, cellulose nano crystals, or any combination thereof.

9. The spill-resistant spout of claim 7, wherein the first discrete layer of barrier material is selected from at least one of: Polyamide, Ethylene Vinyl Alcohol (EVOH), Polyvinyl Alcohol, Thermoplastic Starch, cellulose nano crystals, nano clay, or any combination thereof.

10. The spill-resistant spout of claim 1, wherein the conduit portion and the seal portion are arranged concentrically about an axis A, and wherein each of the one or more side surfaces are substantially parallel to the axis A.

11. The spill-resistant spout of claim 10, wherein the one or more side surfaces of the seal portion comprise one or more lateral grooves configured to permanently engage with the container.

* * * * *